US007467965B1

(12) United States Patent
Arai

(10) Patent No.: US 7,467,965 B1
(45) Date of Patent: Dec. 23, 2008

(54) CONNECTOR

(75) Inventor: Atsushi Arai, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/059,260

(22) Filed: Mar. 31, 2008

(30) Foreign Application Priority Data

Aug. 3, 2007 (JP) ..... 2007-203656

(51) Int. Cl.
*H01R 13/627* (2006.01)

(52) U.S. Cl. ..... 439/353

(58) Field of Classification Search ..... 439/353, 439/357, 358, 953
See application file for complete search history.

(56) References Cited

U.S. PATENT DOCUMENTS 6,146,210 A * 11/2000 Cha et al. ..... 439/680
6,257,925 B1 * 7/2001 Jones ..... 439/557
6,984,143 B2 * 1/2006 Roese ..... 439/352

FOREIGN PATENT DOCUMENTS

JP 2004-179133 A 6/2004

* cited by examiner

*Primary Examiner*—Neil Abrams
*Assistant Examiner*—Phuong Nguyen
(74) *Attorney, Agent, or Firm*—Darby & Darby P.C.

(57) ABSTRACT

A connector assembly making an electrical connection through the mutual engagement of a pair of connectors. One of the connectors has a flexible lock arm, and the other connector has a lock receiver that links to this lock arm. The connector that has the lock arm also has an arm protection part that extends over a substantial portion of an outer surface of the lock arm.

1 Claim, 5 Drawing Sheets

CONNECTOR

CROSS-REFERENCE TO RELATED APPLICATION

The present application claims priority from Japanese Patent Application No. 2007-203656, which was filed on Aug. 3, 2007 and is hereby incorporated by reference in its entirety herein.

FIELD OF THE INVENTION

The present invention relates to an engagement lock structure for a connector that provides an electrical connection through the mutual engagement of a pair of connectors.

BACKGROUND OF THE INVENTION

For example, as is shown in FIG. 4(*a*), one connector 110 belonging to a pair of conventional electrical connectors that are mutually engaged is equipped with a flexible lock arm 113, while the other connector 120 is equipped with a lock receiver 122. As shown in FIG. 4(*b*), the lock arm 113 is elastically linked to the lock receiver, such that the connectors are locked in an engaged position.

However, the lock arm 113 prior to the connector engagement is such that it protrudes from the outer periphery of the connector housing 111, and therefore the lock arm 113 can be struck during application operations, easily resulting in plastic deformation or breakage and thus causing insufficient linking strength of the lock arm 113 or even a condition in which linking is not possible. In this case, the connector must be replaced with a new one, but in the current state in which replacement is difficult to carry out, this can result in a significant drop in operational efficiency.

In Published Unexamined Japanese Patent Application No. JP2004-179133, a technology is disclosed in which breakage due to bending is prevented through the use of a ring-shaped lever receiver. However, not only is the lock lever made longer than the length required for the lock, there is the relationship regarding the undercut between the lock lever part and lever receiver part in the formation of a single unit using resin material, and the problem of high cost results from a complex forming process.

SUMMARY OF THE INVENTION

In light of the technological problems noted above, it is an object of the present invention to provide a connector that has an excellent level of protection from breakage of the lock arm because of external force and can be produced at low cost.

The connector according to the present invention is one in which an electrical connection is made through the mutual engagement of a pair of connectors, and one of the connectors has a flexible lock arm while the other connector has a lock receiver that links to this lock arm, such that the connector that has the lock arm has an arm protection part that extends to the outside of the lock arm.

Here, the reason for equipping the connector having a flexible lock arm with an arm protection part is that the bending of the lock arm can easily lead to deformation or breakage because of external force when linked to the lock receiver.

Further, the lock arm may be installed on either the socket connector side or the plug connector side.

The lock arm may be easily produced through injection molding of resin by forming a base part on the outer periphery of the connector housing of one of the connectors mentioned above. This base part has a lock arm that extends in an engagement direction with the other connector, a specified space on the outer side of this lock arm, and an arm protection part that extends for a specified length along this lock arm.

Here, the reason for having an arm protection part that extends for a specified length is not because of any need for conforming to the length of the lock arm. Any length is suitable that avoids any hindrance with the lock receiver, and that allows the arm protection part to be linked with the lock receiver.

With the connector according to the present invention, an arm protection part that protects the lock arm is provided on the outer side of the lock arm, and for this reason, the lock arm is effectively protected by the arm protection part during application operations, thus preventing breakage of the lock arm.

The arm protection part and lock arm extend from the base of the connector housing in the engagement direction with a connector, and thus it is easy to make a single-unit formation with the connector housing through injection molding. Therefore, a connector having an arm protection part can be produced at low cost.

BRIEF DESCRIPTION OF THE DRAWINGS

The invention will become more readily apparent from the Detailed Description of the Invention, which proceeds with reference to the drawings, in which:

FIG. 2(*b*) is an explanatory drawing in which the housings corresponding to (a) are drawn as longitudinal sections;

FIG. 3(*b*) is an explanatory drawing in which the housings corresponding to (a) are drawn as longitudinal sections.

DETAILED DESCRIPTION OF THE INVENTION

Figure 1:
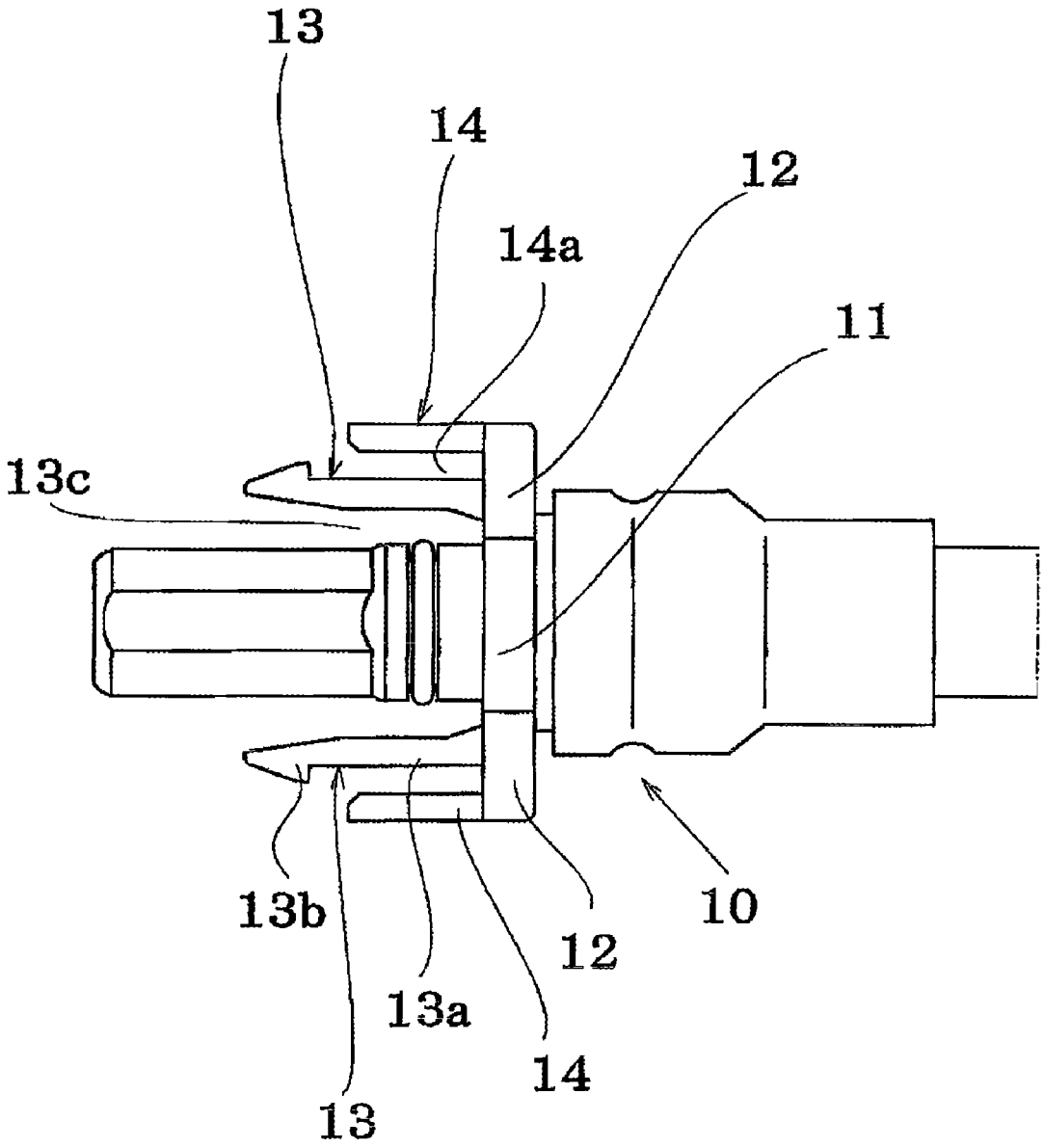
FIG. 1 is an external view of an embodiment of the connector related to the present invention.

The following listing provides a key to the reference numerals and elements depicted in the drawings:

| | |
|---|---|
| 1a, 1b: | Electric lines |
| 2a, 2b: | Core wires |
| 3a, 3b: | Cover parts |
| 10: | Socket connector |
| 11: | Socket connector housing |
| 12: | Base part |
| 13: | Lock arm |
| 13a: | Flexible arm part |
| 13b: | Linking catch |
| 13c: | Arm bending space part |
| 14: | Arm protection part |
| 14a: | Insertion space |
| 15: | Terminal storage chamber |
| 15a: | Lance clip part |
| 16: | Cylindrical engagement part |
| 16a: | O-ring |
| 17: | Cylindrical insertion part |
| 18: | Contracting tube |
| 19: | Socket terminal |

-continued

| | |
|---|---|
| 19a | Lance |
| 20: | Plug connector |
| 21: | Plug connector housing |
| 22: | Lock receiver |
| 23: | Linking part |
| 23a: | Linking end |
| 24: | Arm insertion hole |
| 25: | Terminal storage chamber |
| 25a: | Lance clip part |
| 26: | Cylindrical engagement part |
| 27: | Cylindrical insertion part |
| 28: | Contracting tube |
| 29: | Plug terminal |
| 29a: | Lance |

FIG. 1 shows an embodiment of a connector construction according to the present invention as applied to a socket connector.

Figure 2A:
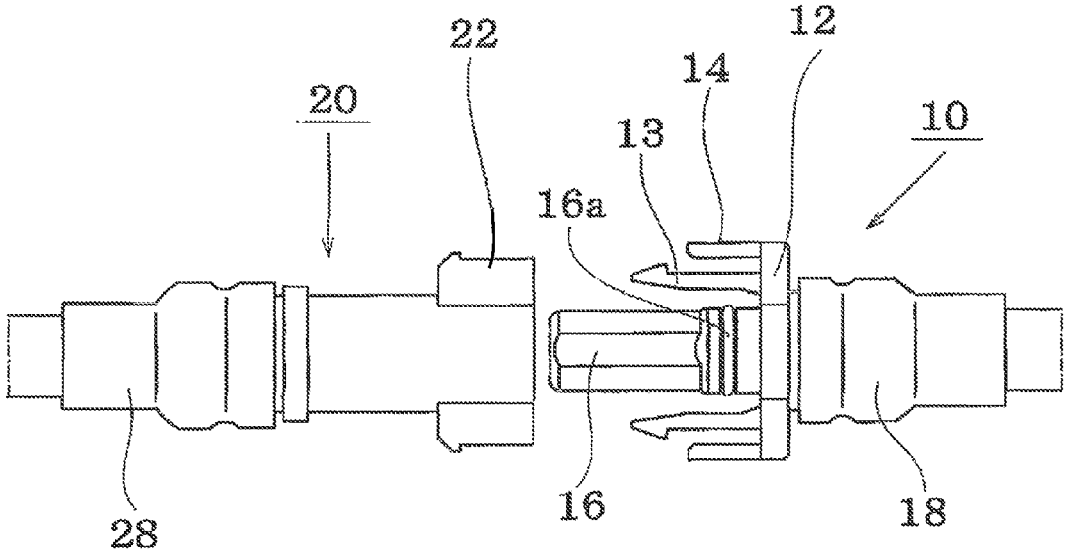
FIG. 2(*a*) is an external view of the socket connector equipped with a lock arm as well as a plug connector equipped with a lock receiver prior to the engagement of the two connectors.
Figure 2B:
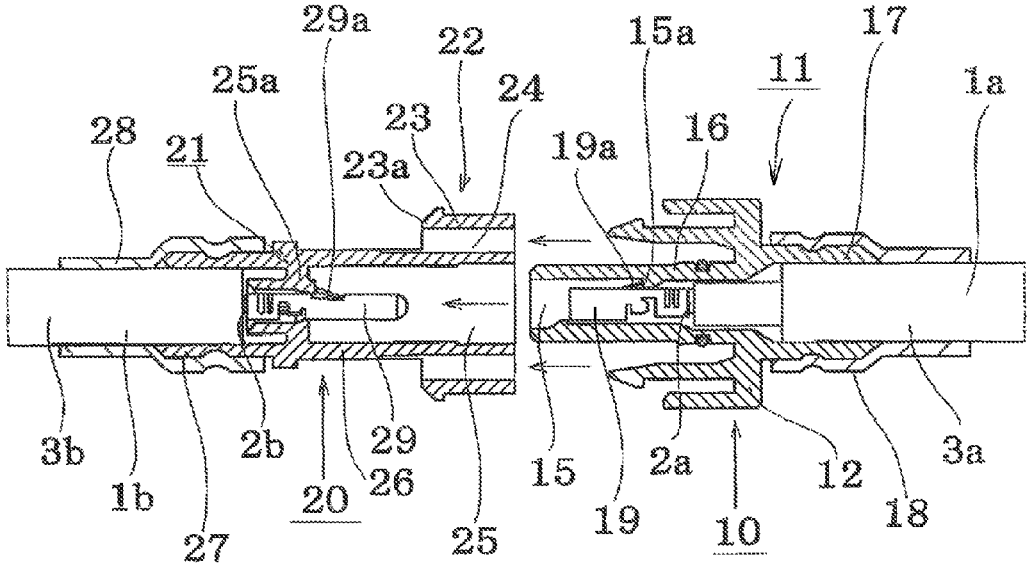

Further, FIG. 2(*a*) is a external view of a socket connector 10 and plug connector 20 prior to engagement, while FIG. 2(*b*) is an explanatory drawing in which the respective housings corresponding to FIG. 2(*a*) are drawn as longitudinal sections.

As shown in FIG. 1, a pair of base parts 12 are erected in symmetrical positions such that they hold the housing 11 between them on the outer periphery of the housing 11 of the socket connector 10.

Also, a flexible lock arm 13 and arm protection part 14 that are linked to a lock receiver 22 of a plug connector 20 of the mating side are installed such that they extend from the respective base parts 12 in the engagement direction with the connector.

Between the lock arm 13 and socket connector housing 11, an arm bending space part 13*c* is provided in order to allow bending of the lock arm 13.

The lock arm 13 is equipped with a flexible arm part 13*a* that extends from the base part 12 in the engagement direction with the connector, as well as a linking catch 13*b* that protrudes outward toward the tip of the flexible arm part 13*a*.

The linking catch 13*b* moves in the inner and outer directions by the bending of the flexible arm part 13*a* in the inner and outer directions with respect to the socket connector housing 11.

The arm protection part 14 is equipped with an insertion space 14*a* between it and the lock arm 13, and this is formed such that it extends from the base part 12 with respect to the socket connector housing 11 along the outer side beyond the lock arm 13 and is nearly parallel to the lock arm 13.

Due to the low level of elasticity of the part of the lock arm 13 that extends from the base part 12, specifically the flexible arm part 13*a*, plastic deformation can occur easily if it is struck, and if the lock arm 13 receives external force in the bending direction to the extent that plastic deformation occurs, the linking strength can drop significantly.

The arm protection part 14 extends from the base part 12 along the outer side in the bending direction of the lock arm 13, and from the external force of the bending direction of the lock arm 13, breakage of the lock arm 13 is prevented, particularly with the protection in the vicinity of this extended flexible arm part 13*a*.

The respective arm protection parts 14 and lock arms 13, with a right-angle directional perspective in the bending direction of the lock arm as well as the engagement direction of the connector with respect to FIG. 1, are formed in such a way that they are turned back in an abbreviated U-shape by the extended base part 12.

Accordingly, the arm protection part 14, lock arm 13, and base part 12 can be resin-formed in a single unit on the socket connector housing 11 through the use of a forming die which narrows in the engagement direction of the connector as well as the right angle in the bending direction of the lock arm.

As shown in FIGS. 2(*a*) and 2(*b*), the socket connector housing ii is cylindrical in shape and provided with a terminal storage chamber 15 that passes through in the engagement direction. Stored within the terminal storage chamber 15 is a socket terminal 19 in which a core wire 2*a* of an electric line 1*a* is connected to one end.

A cylindrical engagement part 16 is provided at the front position of the engagement direction of the socket connector housing 11, and a cylindrical insertion part 17 is provided at the rear position.

The outer periphery of the cylindrical engagement part 16 is equipped with an O-ring 16*a* for shutting out water.

The socket terminal 19 is inserted into the terminal storage chamber 15 from the cylindrical insertion part 17, and the lance 19*a* of the socket terminal 19 is snapped into place in the lance clip part 15*a* on the inner wall of the terminal storage chamber 15 in order to install the socket terminal 19 within the terminal storage chamber 15.

Between the socket connector housing 11 and the electric line 1*a*, from the cylindrical insertion part 17 to the cover 3*a* for the electric line 1*a*, a shrink tube 18 is used to provide a cover and prevent water contact.

A housing 21 for a plug connector 20 is a cylindrical shape equipped with a terminal storage chamber 25 that passes through in the engagement direction, and stored within the terminal storage chamber 25 is a plug terminal 29 in which a core wire 2*b* of an electric line 1*b* is connected to one end.

A cylindrical engagement part 26 is provided at the front position of the engagement direction of the plug connector housing 21, and a cylindrical insertion part 27 is provided at the rear position.

The plug terminal 29 is inserted into the terminal storage chamber 25 from the cylindrical insertion part 27, and a lance 29*a* of the plug terminal 29 is snapped into place in the lance clip part 25*a* on the inner wall of the terminal storage chamber 25 in order to install the plug terminal 19 within the terminal storage chamber 25.

Between the plug connector housing 21 and the electric line 1*b*, from the cylindrical insertion part 27 to the cover 3*b* for the electric line 1*b*, a shrink tube 28 is used to provide a cover and prevent water contact.

A lock receiver 22 is provided in the position corresponding to the lock arm 13 of the socket connector 10 on the outer periphery of the plug connector housing 21.

The lock receiver 22, which passes through in the connector engagement direction, is somewhat cylindrical in shape, and an arm insertion hole 24 is installed on the inside of this cylinder in order to plug in the flexible arm part 13*a* of the lock arm 13 during engagement of the connector.

A linking part 23 in which the linking catch 13*b* is elastically linked when the connector is engaged, as the linking catch 13*b* of the socket connector 10 slides and plugs into the plug-in space 14*a*, is provided on the cylindrical outer side wall.

Figure 3A:
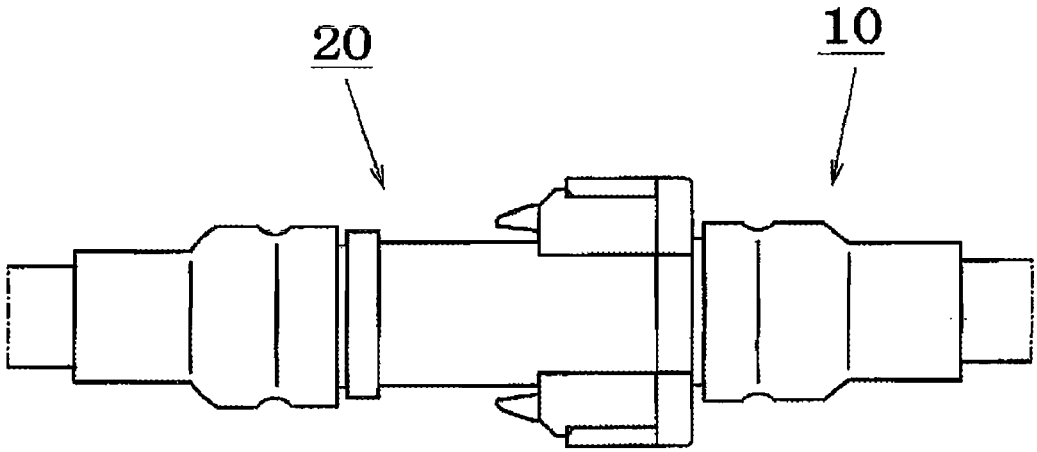
FIG. 3(*a*) is an external view of the socket connector and plug connector in their engaged state.
Figure 3B:
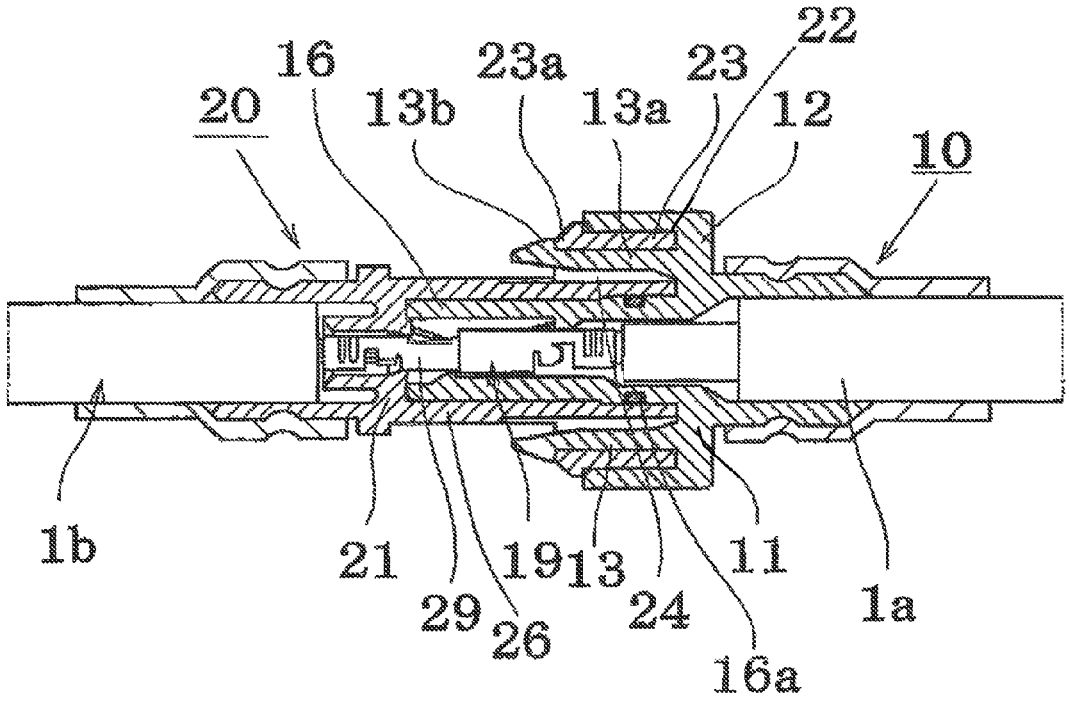
Figure 4A:
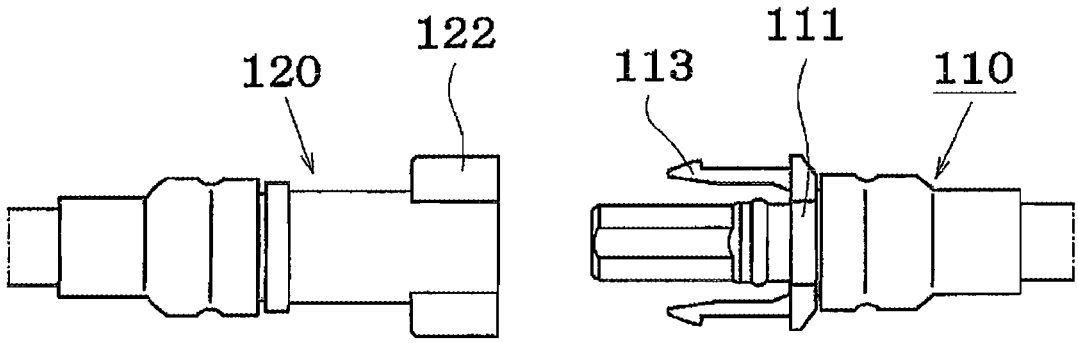
Figure 4(a) (Prior Art)
FIGS. 4(*a*) and 4(*b*) show the engagement lock structure of a conventional connector.
Figure 4B:
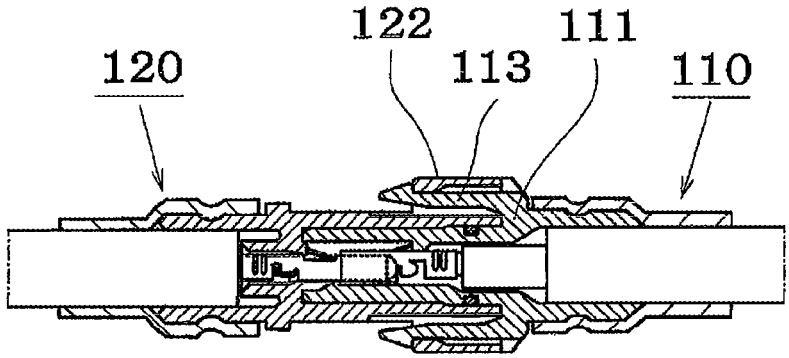
Figure 4(b) (Prior Art)

FIG. 3(*a*) shows an external view of the socket connector 10 and plug connector 20 in their engaged state, and FIG. 3(*b*) is an explanatory diagram of the housings corresponding to FIG. 3(*a*) drawn as longitudinal sections.

With regard to the socket connector 10 and plug connector 20, the cylindrical engagement part 16 of the socket connector housing 11 is inserted into the cylindrical engagement part of the plug connector housing 21 so that the socket terminal 19 and plug terminal 29 are mutually engaged.

Accordingly, the electric line 1*a* connected to the socket terminal 19 forms a trunk connection with the electric line 1*b* connected to the plug terminal 29.

As for the engaged part between the socket connector 10 and plug connector 20, an O-ring 16*a* provided on the outer periphery of the cylindrical engagement part 16 of the socket connector 10 slides into the inner surface of the cylindrical engagement part 26 of the plug connector 20 to cut off water, and thus water contact with the connection between the socket terminal 19 and plug terminal 29 is prevented.

The linking catch 13*b* slides into the linking part 23 during connector engagement, and while the flexible arm part 13*a* bends inward, the lock arm 13 is inserted into the arm insertion hole 24 of the lock receiver 22, and at the connector engagement position the linking catch 13*b* makes an elastic link in the linking end 23*a* at the rear end of the linking part 23 to lock the connector engagement in place.

It is within the scope of the present invention to include all foreseeable equivalents to the elements of the present invention as disclosed with reference to FIGS. 1-3. The examples provided by the disclosure are not to be interpreted as limiting the invention beyond that which is claimed.

The invention claimed is:

1. A connector assembly in which an electrical connection is made through the mutual engagement of a pair of connectors, wherein one of the connectors has a flexible lock arm while the other connector has a lock receiver that links to this lock arm when the pair of connectors is mutually engaged, the connector that has the lock arm further including an arm protection part that extends over an outer side of the lock arm and a base part formed on the outer periphery of a housing of the one connector, the lock arm extending from the base part in an engagement direction toward the other connector and the arm protection part extending from the base part toward the other connector for a specified length along the outer side of the lock arm, wherein when the pair of connectors is mutually engaged, a distal end of the arm projection part extending from the base part meets a projecting surface of a collar portion extending outwardly from an outer surface of the lock receiver.

* * * * *